United States Patent [19]

Seshima

[11] 4,101,120

[45] Jul. 18, 1978

[54] ELECTRICALLY DRIVEN, SEPARATE TYPE, SURGICAL OPERATION TABLE

[75] Inventor: Kensuke Seshima, Tokyo, Japan

[73] Assignee: Mizuho Ika Kogyo Kabushiki Kaisha, Tokyo, Japan

[21] Appl. No.: 793,911

[22] Filed: May 4, 1977

[30] Foreign Application Priority Data

Aug. 10, 1976 [JP] Japan ..... 51-94538

[51] Int. Cl.[2] ..... A61G 13/00

[52] U.S. Cl. ..... 269/323

[58] Field of Search ..... 269/322–327; 5/81 R

[56] References Cited

U.S. PATENT DOCUMENTS 3,362,704 1/1968 Pilz ..... 269/325

*Primary Examiner*—Robert C. Watson

*Attorney, Agent, or Firm*—Ladas, Parry, Von Gehr, Goldsmith & Deschamps

[57] ABSTRACT

In a surgical operation table having an upper structure for supporting the body of a patient, separably supported by a lower structure on a part vertically movable relative to the remaining parts thereof and rotatable around the longitudinal and transverse axes of the table, a guiding device comprising a guiding pin and a guiding bush combined respectively with mating halves of an electric connector and a locking device comprising an electrically driven locking screw and a nut are provided on the engaging surfaces of the upper structure and the above mentioned part of the lower structure, which are driven through a two-line electric circuit of a reduced voltage.

9 Claims, 19 Drawing Figures

• NC
○ NO
POWER SOURCE FOR CONTROL CIRCUITS
TO MOTOR CIRCUITS
A.C.
FOR MOVEMENT OF BACK SUPPORTING FRAME
FOR ROTATION ABOUT LONGITUDINAL AXIS
FOR ROTATION ABOUT TRANSVERSE AXIS
FOR VERTICAL MOVEMENT
66 CONNECTORS
RM
RS
PL
VL
TR1
TR2
RC1
RC2
RC3
M1
M2
M3
M4
M5
M6

ELECTRICALLY DRIVEN, SEPARATE TYPE, SURGICAL OPERATION TABLE

BACKGROUND OF THE INVENTION

This invention relates generally to surgical operating tables, and more particularly to a type thereof wherein an upper structure for supporting the body of a patient is detachably mounted on a part of a lower structure which is adapted to move up-and-down and to rotate around the longitudinal axis and the transverse axis of the operating table, and furthermore all of the aforementioned movements of the part of the lower structure as well as the swinging movement of a part of the upper structure for supporting the back of the patient are made by individually provided electric motors.

Heretofore, a surgical operating table of a separate type wherein the upper structure can be elevated, lowered, and rotated around the longitudinal and transverse axes of the operating table, a part of the upper structure supporting the back of a patient being swingable in a vertical plane, has been widely known.

Although the above described type of surgical operating table has various advantageous features, it is found that the conventional surgical operating table of this type is still accompanied by several problems as described below.

Firstly, when the upper structure removed off the lower structure and transported on a wheeled stretcher (hereinafter referred to simply as a stretcher) with a patient supported on the upper structure is required to be mounted on the upper structure again on the lower structure, or conversely when the upper structure supporting the patient thereon is to be dismounted from the lower structure and fixed on the stretcher, it must be manually assured that the upper structure has been brought back into the horizontal disposition, and the hoisting circuit for the upper structure must be manually cut off for eliminating any accidental energization of the circuit during the engaging and locking operations of the upper structure.

Furthermore, the construction and the arrangement of the parts of the rotating mechanism, for rotating the upper structure around the two axes, of the conventional surgical operating table have been such that there are tendencies of the operation of the surgical table to be disturbed and of the observation range in X-ray photography to be restricted.

In addition, the electric system of the conventional surgical operating table has been such that all of the electric motors and the control circuits are operated at the line voltage in the district of usage through an elaborate cord system or slip-ring system.

SUMMARY OF THE INVENTION

With the above described problems of the conventional surgical operation table in view, a primary object of the present invention is to provide an improved separate type surgical operating table, wherein a guiding mechanism is provided for facilitating the engagement between the upper structure and a supporting part of the lower structure, and electrical connectors for the power and control circuits led into the upper structure are incorporated with the guiding mechanism.

Another object of the invention is to provide an improved separate type surgical operating table wherein a locking mechanism is provided between the upper structure and the part supporting the upper structure of the lower structure, and the completion in operation of the locking mechanism is correlated and interlocked with the operation of a hoisting motor which hoists the supporting part relative to the stationary part of the lower structure.

Still another object of the present invention is to provide an improved separate type surgical operating table wherein all electrical circuitries provided in the surgical operating table are operated at a reduced voltage in a two-line system so that hazards caused by leakage current can be completely eliminated.

Still another object of the present invention is to provide an improved separate type surgical operating table wherein a resetting circuit is provided to operate automatically when a stretcher carrying the upper structure is brought into a predetermined position relative to the lower structure, and the part supporting the upper structure of the lower structure is thereby reset to its neutral horizontal position.

The above described objects and other objects which will be made apparent hereinafter can be achieved by an improved, electrically driven, separate type surgical operating table comprising an upper structure for supporting the body of a patient, and a lower structure including a part supporting the upper structure in a separable manner, the part being movable up-and-down in the lower structure and rotatable around the longitudinal and transverse axes of the operation table, in which there is provided the improvement comprising means for guiding the engagement between the upper structure and the part supporting the upper structure of the lower structure, and means for locking the upper structure onto the part of the lower structure, the guiding means comprising a guiding pin and a guide bush, respectively combined with mating halves of an electric connector used in an electric circuit for driving the surgical operating table, while the locking means comprises an electrically driven locking screw and a mating nut provided respectively in the upper structure and the supporting part of the lower structure.

In a preferred example of the electrically driven, separate type surgical operating table, a guiding means and a locking means are provided on each lateral side between the upper structure and the part supporting the upper structure of the lower structure, and the electric circuits for driving the operation table are formed into a two-line system operated at a reduced voltage.

The invention will be better understood from the following detailed description of the invention when read in conjunction with the accompanying drawings, wherein like parts are designated by like reference numerals.

DETAILED DESCRIPTION

Figure 1:
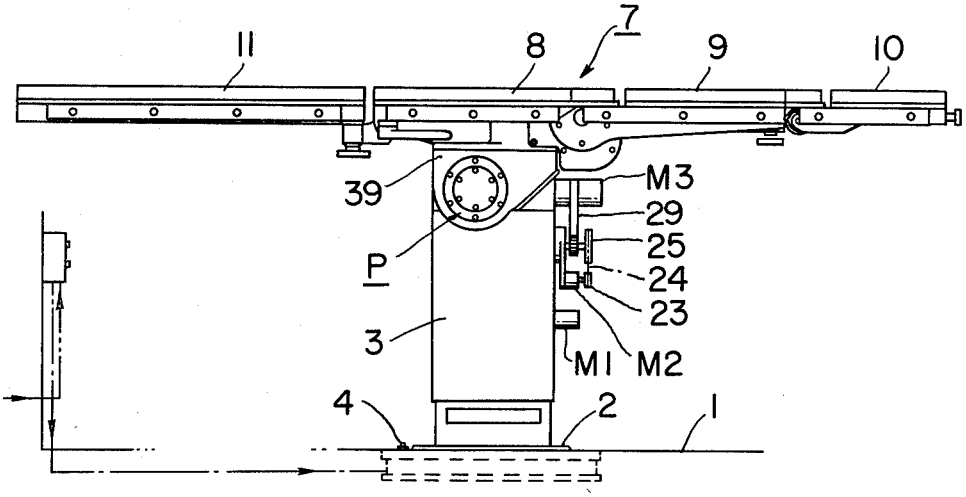
FIG. 1 is a side elevation of a separate type surgical operating table according to the present invention, wherein an upper structure for supporting a patient is secured on a lower structure.
Figure 2:
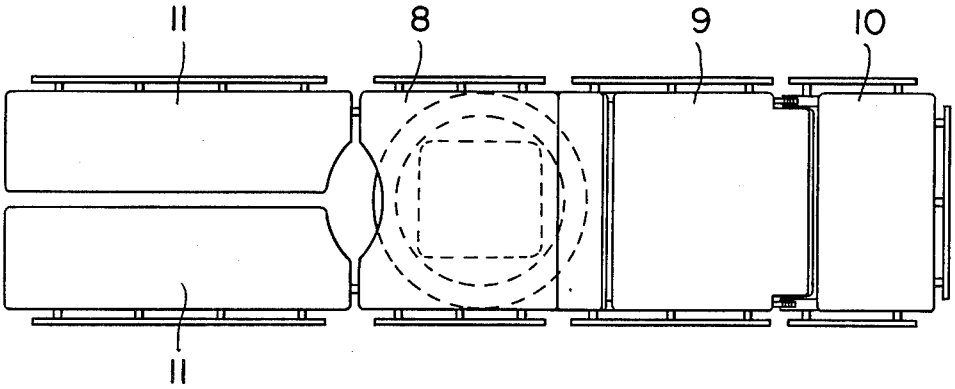
FIG. 2 is a plan view of the surgical operating table shown in FIG. 1.
Figure 3:
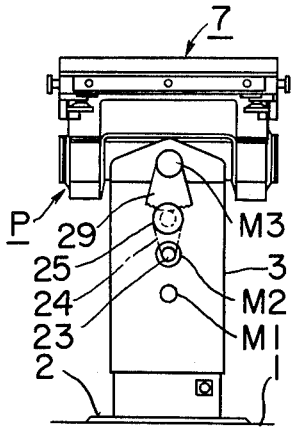
FIG. 3 is an end elevational view of the same surgical operating table shown in FIGS. 1 and 2.

Referring to FIGS. 1 through 4, there is illustrated a separate type, electrically driven, surgical operating table which is stationed on the floor 1 of a surgical operation room or the like through a mounting device 2 comprising two parts, one being rotatable about a vertical axis on the other buried in the floor through an angle of 180° when a stepping button 4 is depressed. The operation table has an upper structure generally designated by 7, on which the body of a patient to be operated on is laid, and a lower structure which comprises a columnar member 3 secured rigidly to the rotatable part of the mounting device 2, and a member 5 slidable up-and-down within the columnar member 3.

In this example of the surgical operating table, the upper structure 7 for supporting the body of the patient comprises a central frame 8, a frame 9 for supporting the back of the patient, hinged to one of the laterally extending edges of the central frames 8 to be swingable therearound, a frame 10 for supporting the head of the patient hinged to the laterally extending distal edge of the frame 9 to be swingable therearound, and frames 11 for supporting the legs of the patient secured detachably to the opposite side of the central frame 8 at a level adjustable relative to the central frame 8. The lower surface of the central frame 8 is detachably coupled to the upper surface of a supporting part of the lower structure, which is rotated through a biaxial rotating mechanism P described hereinafter in more detail.

Figure 14:
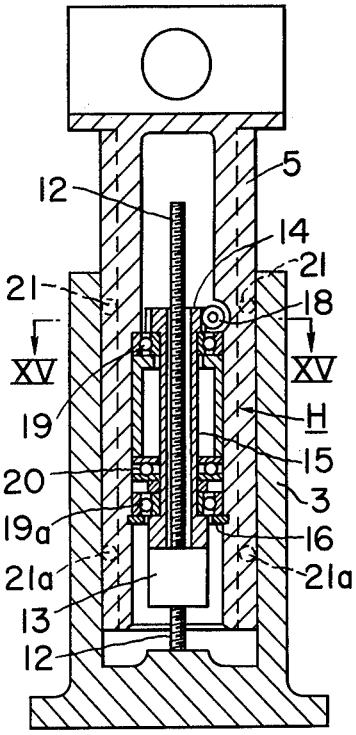
FIG. 14 is an elevational view of the lower structure of the operating table, in which a columnar structure coupled with the member supporting the upper structure is movable upwardly and downwardly.
Figure 15:
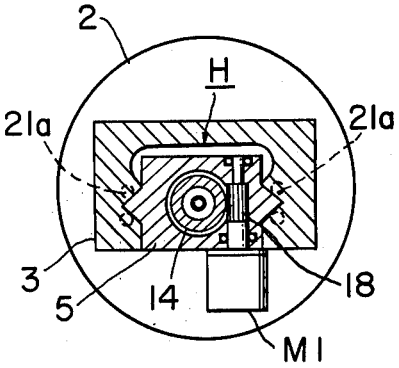
FIG. 15 is a sectional view taken along the line XV—XV in FIG. 14.
Figure 16:
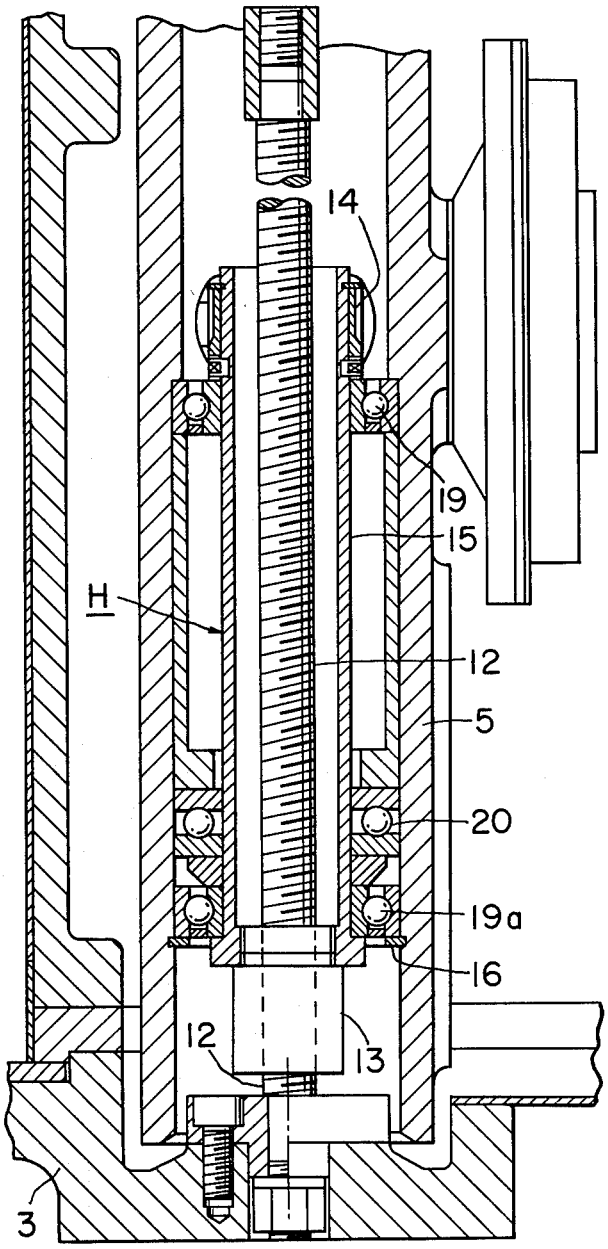
FIG. 16 is an elevational view, on a much enlarged scale and in section, of the lower part of the columnar structure.

The sliding member 5 is moved up-and-down within the columnar member 3 by means of a hoisting mechanism H, shown in FIGS. 14, 15 and 16 which comprises a vertically extending tubular member 15 having an upper end fixedly mounting a worm gear 14 and a lower end secured to a ball nut 13, and a ball screw threaded rod 12 extending within the tubular member 15 to mesh with the ball nut 13 and having its lower end secured to the bottom of the columnar member 3. The tubular member 15 is rotatable within the sliding member 5 but not movable upward or downward relative to the sliding member 5 because of the presence of stop rings 16.

A worm 18 driven by an electric motor M1 secured to the sliding member 5 meshes with the worm gear 14, and rotates the same together with the tubular member 15 and the ball nut 13, so that the tubular member 15 with the ball nut 13 and the sliding member 5 are moved together upwardly or downwardly depending on the driving direction of the electric motor M1. As shown in FIGS. 14 and 16, radial ball bearings 19 and 19a, and a thrust bearing 20 are provided between the tubular member 15 and the sliding member 5, and guide balls 21 and 21a are provided between the columnar member 3 of the lower structure and the sliding member 5.

Since the ball screw threaded rod 12 and ball nut 13 of high transmission efficiency are used in the hoisting mechanism H, and low frictional guide balls are used between the columnar member 3 and the sliding member 5, the frictional resistance between these two members is extremely low, the tendency of the elevated members to descend naturally being suppressed solely by the frictional resistance between the worm gear 14 and the worm 18 engaging therewith. Furthermore, because of a high mechanical efficiency of the hoisting mechanism H, the power required for driving the operational table and therefore the size of the operation table can be substantially reduced.

The construction of the biaxial rotating mechanism P will now be described with reference to FIGS. 4, 11, 12, and 13.

In order to rotate the supporting part of the lower structure, which is formed in this example with two members 38 and 39, an electric motor M2 is mounted on an upper part of the sliding member 5. The electric motor M2 drives a pulley 23 which drives another pulley 25 of a greater diameter through an endless belt 24. The rotating shaft 26 of the pulley 25 is coupled through a reduction gear 27 to a pinion gear 28 provided coaxially with the shaft 26. The pinion gear 28 meshes with a sector gear 29 which has a tubular stem portion 30 supported through bearings 31 and 31*a* by the upper part of the sliding member 5.

Another electric motor M3 is mounted coaxially on an end of the tubular stem portion 30 of the sector gear 29. The rotation of the electric motor M3 is transmitted through a first speed-reduction mechanism 34, a shaft 32 extending through the tubular stem portion 30, and a pair of mutually orthogonally disposed gears 35*a* and 35*b*, to a laterally extending shaft 36, and the rotation of the shaft 36 is then transmitted through a pair of second speed-reduction mechanisms 37 of differential gear type to the supporting members 38 and 39 provided at respective ends of the shaft 36. More specifically, the supporting members 38 and 39 are provided at respective ends of the shaft 36 rotatably extending through a casing 40 which is formed integrally with the tubular stem portion 30 of the sector gear 29, constituting a casing for the longitudinal shaft extending between the first speed-reduction mechanism 34 and the orthogonal gears 35.

With the above described construction of the bi axial rotating mechanism P, the upper structure 7 supported on the supporting members 38 and 39 can be rotated around a longitudinal axis and a transverse axis of the operating table.

The frame 9 for supporting the back of a patient is swung around an edge of the central frame 8 through a swinging mechanism which is constructed as follows.

Figure 4:
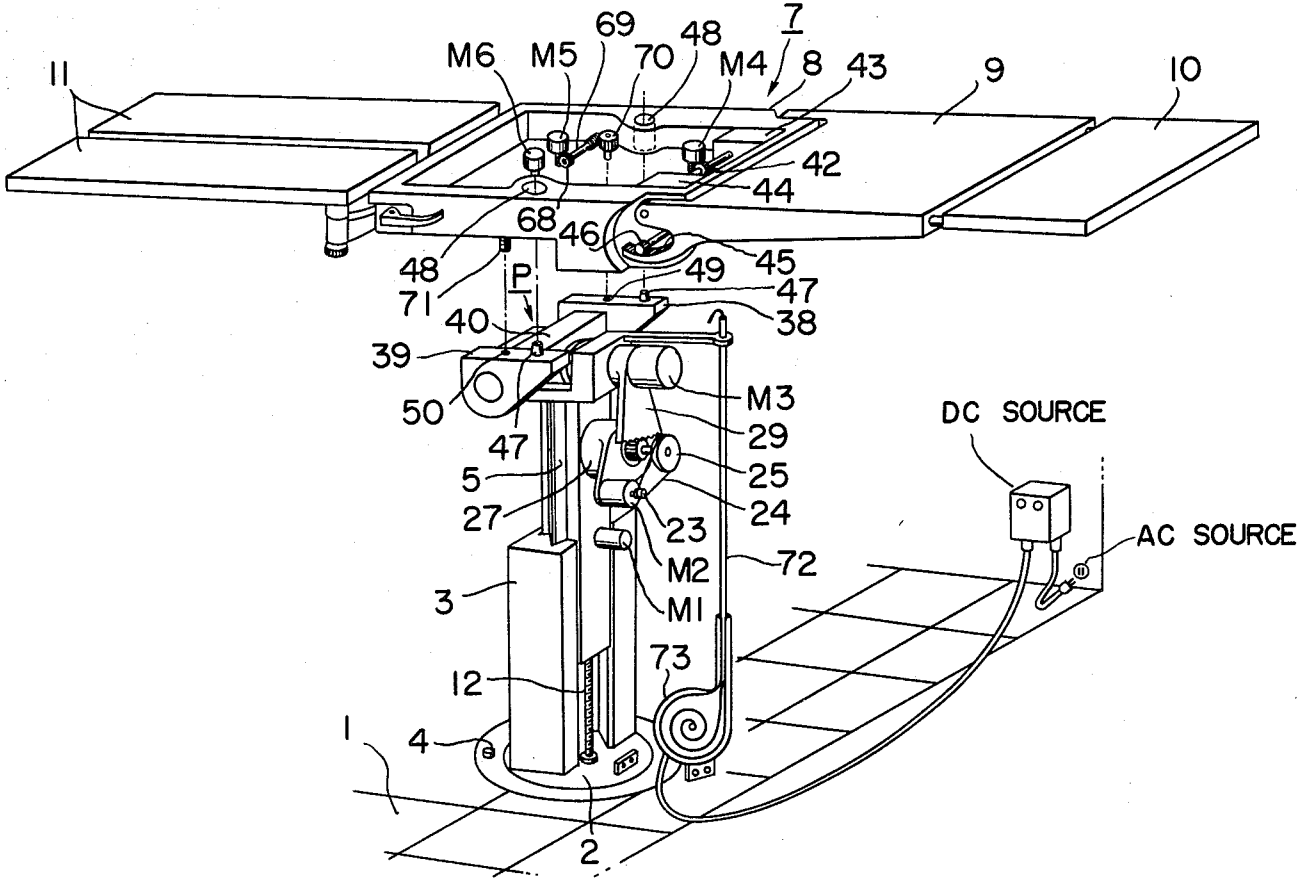
FIG. 4 is a perspective view of the separate type surgical operating table shown in FIGS. 1, 2, and 3.

Referring to FIG. 4, an electric motor M4 is provided in the central frame 8 of the upper structure 7. The rotation of the electric motor M4 is transmitted through a worm-and-worm gear combination 42 and a pair of speed-reduction mechanisms 43 and 44 provided on the lateral ends of the worm gear shaft to pinions 46 meshing respectively with internally toothed gears 45 provided on opposite sides of an edge of the frame 9, adjacent to the central frame 8 of the upper structure.

Before entering into a description of a guide pin combined with a connector and of a screw type lock mechanism, both constituting an important part of this invention, a mechanism for fixing a stretcher at a predetermined position relative to the operating table will be described with reference to FIGS. 5, 6, 7, and 8.

Figure 5:
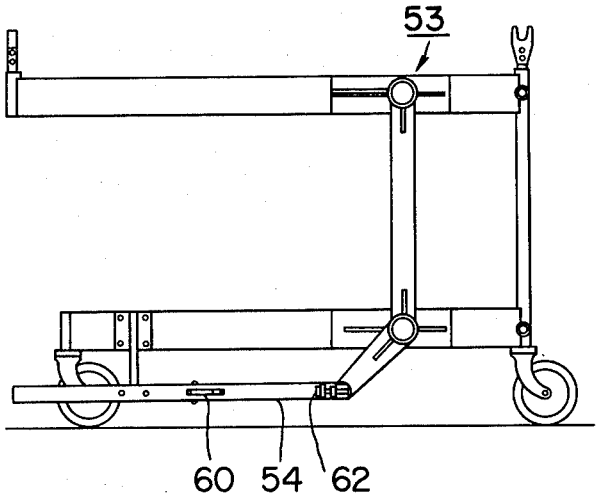
FIG. 5 is a side elevation of a stretcher for carrying the upper structure of the surgical operating table thereon.
Figure 6:
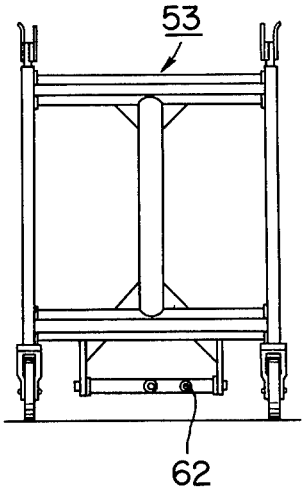
FIG. 6 is an end elevational view of the stretcher shown in FIG. 5.
Figure 7:
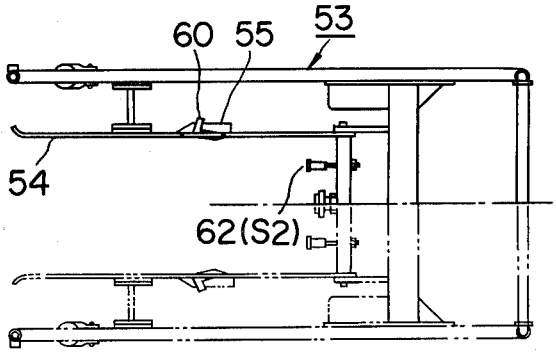
FIG. 7 is a plan view showing the stretcher shown in FIGS. 5 and 6.
Figure 8:
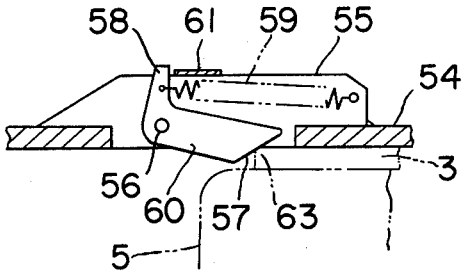
FIG. 8 is a fragmental plan view showing, on much enlarged scale, a locking mechanism for locking the stretcher at a predetermined position relative to a lower structure of the operating table.

This mechanism is essential in the transferring operation of the upper structure of the operating table from a stretcher onto the lower structure of the same table or vice versa. The stretcher generally designated by numeral 53 is of a frame-like construction, as shown in FIGS. 5, 6, and 7, on which the upper structure of the operating table can be carried, the entire structure of the stretcher being supported on wheels. At least the lower part of the frame-like body of the stretcher 53 opens forwardly, so that the stretcher can be brought into a position overlying the lower structure of the operating table. A pair of guide rails 54 are provided on the lateral sides of the interior of the stretcher for facilitating the reception of the columnar member 3 of the lower structure within the stretcher, and on these guide rails 54 a positioning mechanism for bringing the stretcher to a predetermined position is provided as shown in FIG. 8.

The positioning mechanism consists of two parts symmetrical with respect to the longitudinal axis of the stretcher, each part comprising a bracket 55 secured onto the laterally outer surface of the guide rail, a catch member 60 pivotally supported on the bracket 55 at an intermediate point 56 of the catch member 60, and a spring 59 stretched between an end of the catch member 60 and the bracket 55 for urging the catch member 60 into a rotating movement thereby exposing the other end of the catch member 60 inwardly from the guide rail 54. The end of the catch member 60 is formed to have a tapered surface 57, constantly spaced apart from the pivotal point 56 laterally outwardly.

The mechanism further includes a stop member 61 secured to the bracket 55 for limiting the inward exposure of the tapered surface 57 of the catch member 60 to an appropriate value, and also another stop member 62 provided at a rearward end position within the stretcher for limiting the intrusion of the columnar member 3 therein in excess of the predetermined extent. This stop member 62 is incorporated with a hereinafter described switch $S_2$ which is operated when the stretcher is brought into the predetermined position relative to the columnar member 3 of the operating table.

In the case where the stretcher of the above described construction is advanced toward the columnar member of the operating table, the lateral surfaces of the columnar member 3 are guided between the guide rails 54. The leading edges or corners of the columnar member 3 in the mean time abut against the catch members 60 thereby rotating the catch members 60 laterally outwardly against the forces of the springs 59.

When the stretcher is brought nearer to the predetermined position relative to the columnar member, the catch members 60 slidingly contacting the lateral surfaces of the columnar member are finally rotated inwardly under the forces of the springs 59, so that the tapered surfaces 57 at the end of the catch members 60 abut against the rear corners 63 of the columnar member 3 as shown in FIG. 8. Simultaneously, the leading surface of the columnar member 3 abuts against the stop member 62, and the stretcher is thereby fixed to the predetermined position relative to the columnar member 3.

Figure 9:
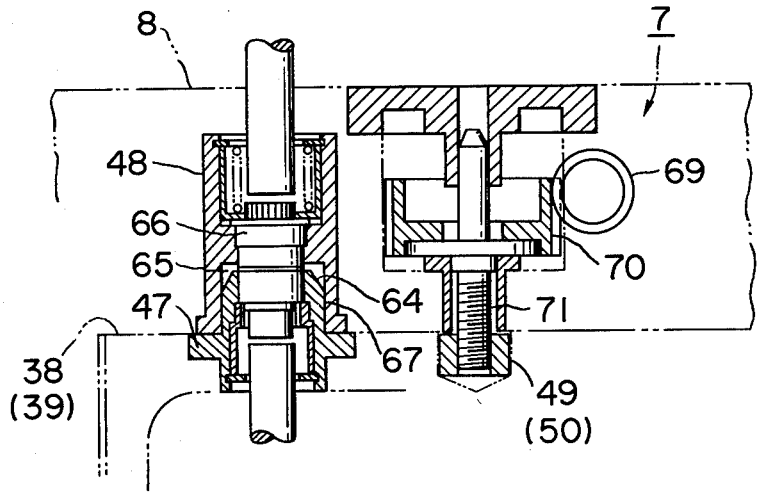
FIG. 9 is an elevational view, in vertical section, of a guiding mechanism and a locking mechanism provided between the upper structure and the member supporting the upper structure of the lower structure.

At the time when the position of the stretcher carrying an upper structure of the surgical table is thus fixed, the sliding member 5 may now be elevated within the columnar member 3 until a tapered end 64(FIG. 9) of a guide pin 47, which is provided on each of supporting members 38 and 39 and incorporated with a part of an electrical connector as will be described hereafter, enters an inner bore 65 of a guide bush 48 provided in the central frame 8 and incorporated with the other part mating with the first part of the connector 66, thereby starting the connection between the mating parts of the connector 66. At an instant when a cylindrical surface portion 67 of the guide pin 47 has been completely inserted into the bore 65 of the guide bush 48, the connection of the mating parts of the connector 66 is completed. Since the electrical connector 66 is disposed coaxially with the guide pin and the guide bush incorporated therewith, the positional error between the mating parts of the connector 66 can be minimized, and the connection of the connector 66 can be thereby assured.

While the sliding member 5 is elevated within the columnar member 3 as described above, in addition to the above mentioned guiding mechanism, a locking mechanism is also operated for locking the upper structure so far carried on the stretcher onto the supporting members 38 and 39 coupled through the rotating mechanism P to the upper part of the sliding member 5.

Figure 10:
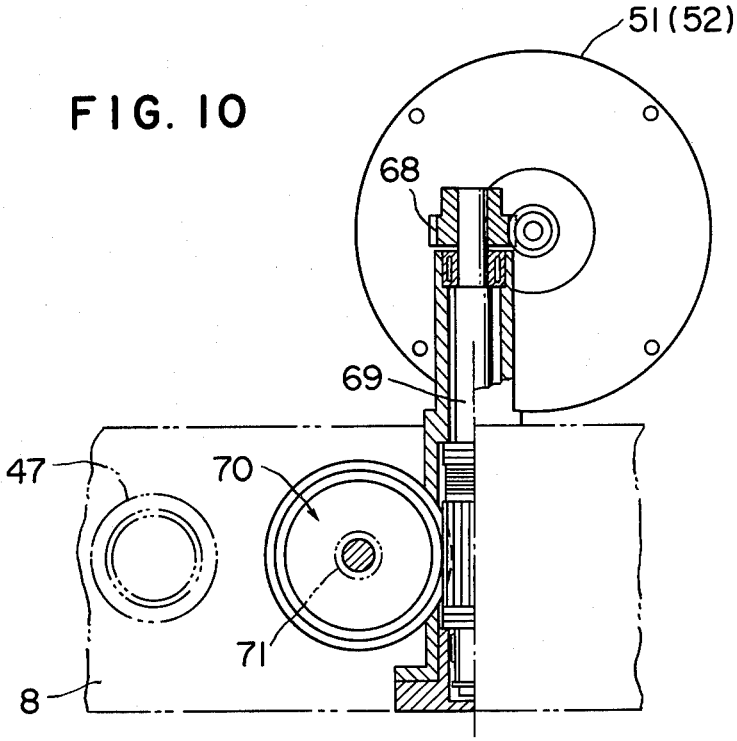
FIG. 10 is a schematic plan view showing a part of the operating table, wherein a driving system of the locking mechanism is illustrated.
Figure 11:
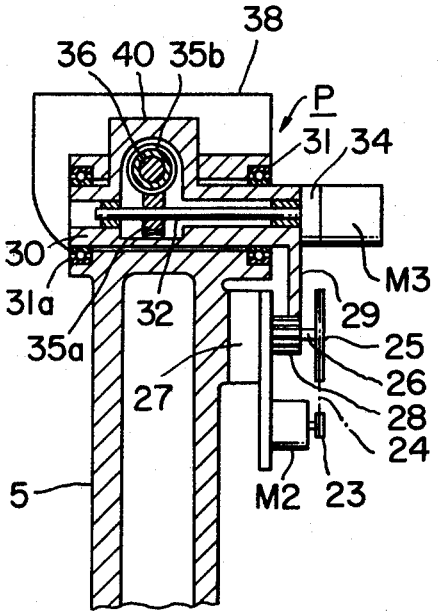
FIG. 11 is a fragmental elevational view partly in section showing a part of the lower structure including mechanisms for rotating the supporting member around the longitudinal and transversal axes of the upper structure.
Figure 12:
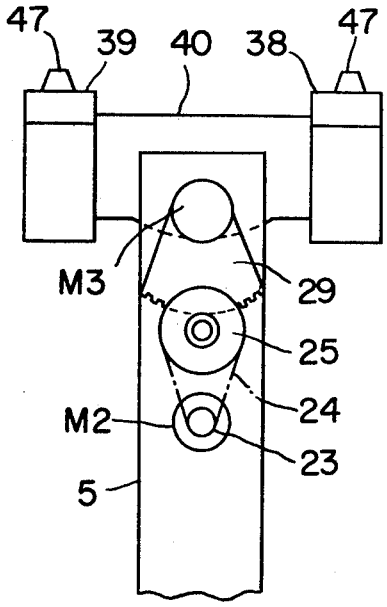
FIG. 12 is a front elevational view of the part shown in FIG. 11.
Figure 13:
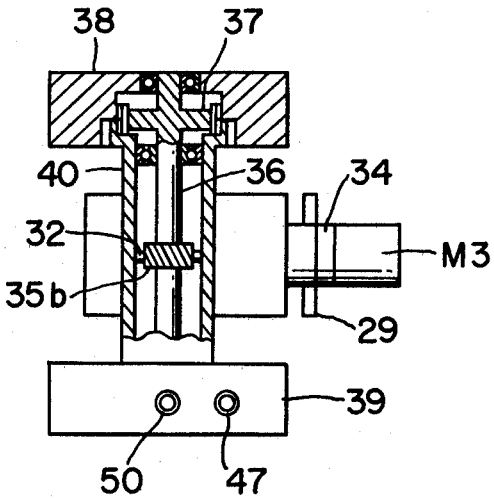
FIG. 13 is a plan view, partly in section, of the part shown in FIG. 11.

The locking mechanism comprises, as shown in FIG. 4, electric motors M5 and M6 provided on the lateral sides of the central frame 8 of the upper structure, and worm gears 68 each transmitting the rotation of the associated electric motor to a laterally extending shaft 69 provided for the associated motor. The rotation of the shaft 69 is further transmitted through orthogonally disposed gears 70 to a vertical screw-threaded rod 71 (see FIGS. 9 and 10).

When it is required that the upper structure, so far carried on the stretcher and now guided into engagement with the supporting members 38 and 39 by the guiding pins 47, be locked to the same supporting members, the electric motors M5 and M6 are both operated in the locking direction, whereby the screw-threaded rods 71 on both sides of the central frame 8 are brougth into engagement with nuts 49 and 50 imbedded in the supporting members 38 and 39, respectively.

In the case when it is desired to dismount the upper structure from the supporting members 38 and 39 coupled through the mechanism P to the sliding member 5, the locking mechanism is first operated in the unlocking direction so that the screw-threaded rods 71 are screwed out of the nuts 49 and 50, and the supporting members 38 and 39 are lowered as the sliding member 5 is lowered within the columnar member 3 of the lower structure, against which a stretcher is located at a predetermined position.

Thus the upper structure is now held on the stretcher, and the guiding mechanism is disengaged with the simultaneous disengagement of the electrical connector 66.

It should be noted that in either of the cases for mounting or dismounting the upper structure, it is important that the upper structure and the supporting members 38 and 39 be both brought accurately into horizontal state with respect to the longitudinal axis and the transverse axis of the operating table.

Figure 18:
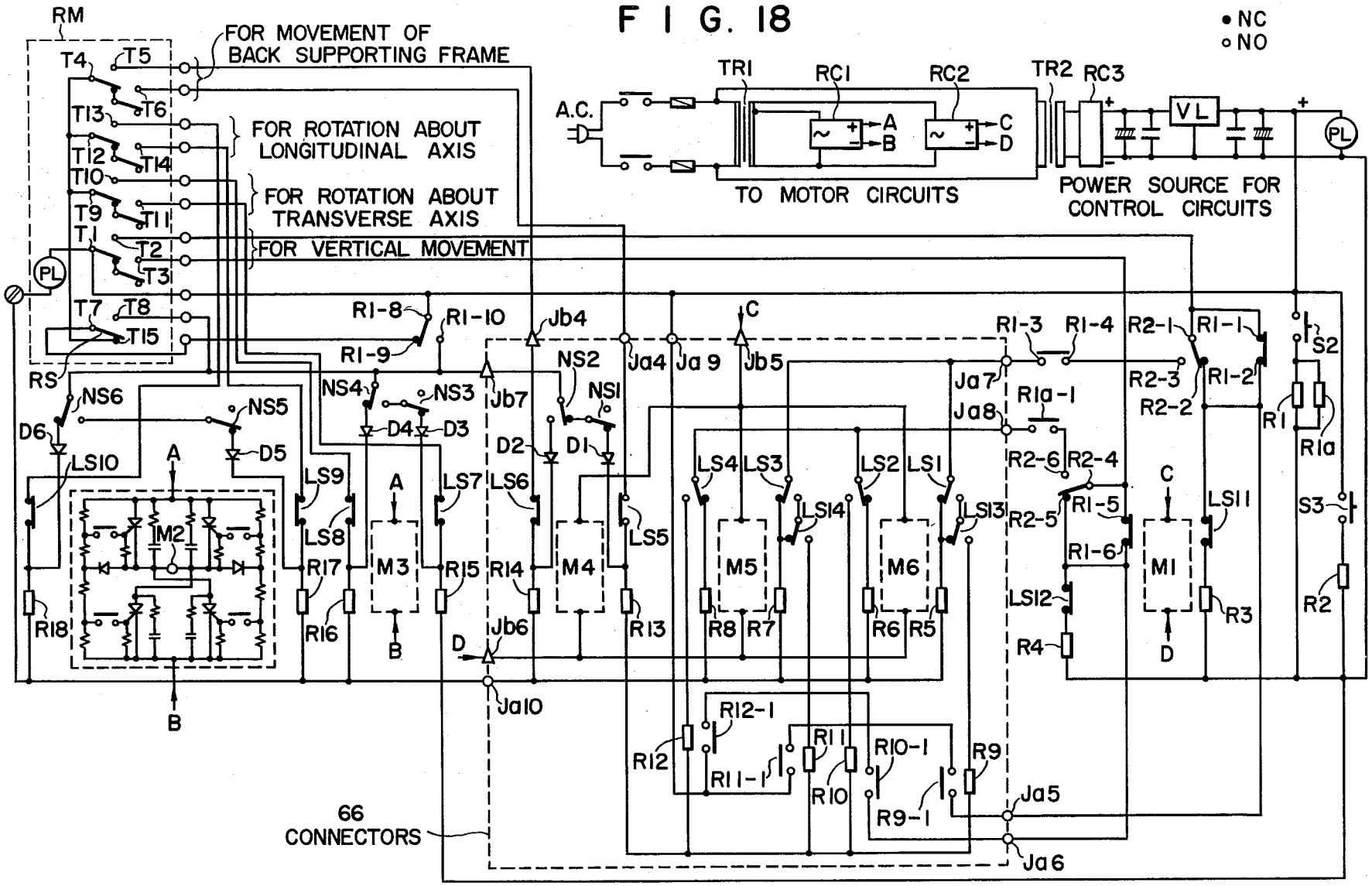
FIG. 18 is an electrical circuit diagram for the separate type surgical operating table according to this invention.

The electric motors for elevating the sliding member 5 together with the upper structure, for rotating the same structure around the two axes, and for swinging its back supporting frame in a vertical plane, and also for operating the locking mechanism, are operated and controlled by an electric circuit as shown in FIG. 18.

As will be apparent from the circuit diagram, the line voltage of an a.c. power source is reduced to a low voltage through transformers TR1 and TR2, the former being connected to two rectifiers RC1 and RC2 and the latter being connected to a rectifier RC3. The output d.c. power (A,B) from the rectifier RC1 is supplied to electric motors M2 and M3 for rotating the upper structure around the longitudinal and transverse axes, respectively, while the output d.c. power (C,D) from the rectifier RC2 is supplied to electric motors M1, M4, M5, and M6 for elevating and lowering the upper structure, vertical swinging of the back supporting frame 9 of the structure, and driving the right and left screw-threaded rods of the locking mechanisms, respectively. The output d.c. power from the rectifier RC3 connected to the transformer TR2 is used for the control circuits for all of the above described motors.

The a.c. power source, transformers TR1 and TR2, and the rectifiers RC1, RC2, and RC3 are all installed at positions separate from the operating table, such as on the wall of the operating room. The control circuitries other than those included in a remote control box RM indicated by a broken line in FIG. 18 is preferably installed on a stationary structure, such as the wall of the operating room.

Figure 17A:
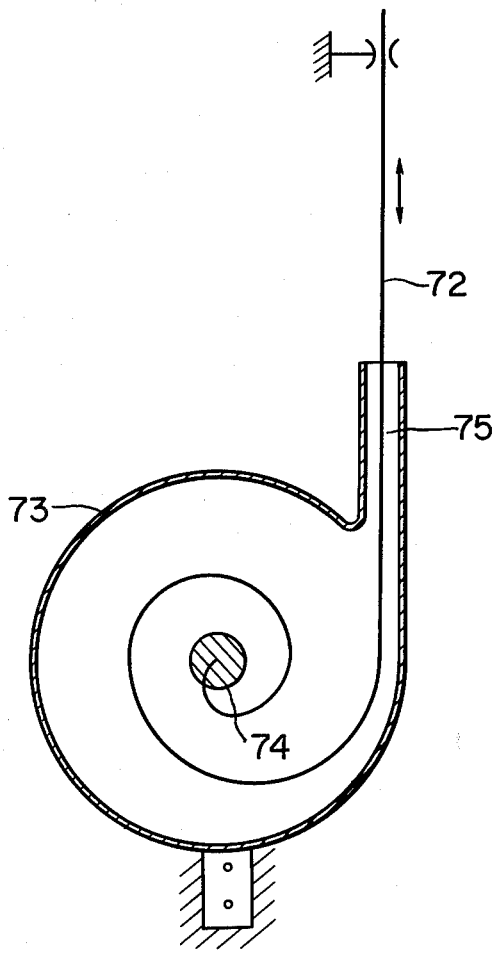
FIGS. 17A and 17B are diagrams respectively showing a cord winding device in different states.
Figure 17B:
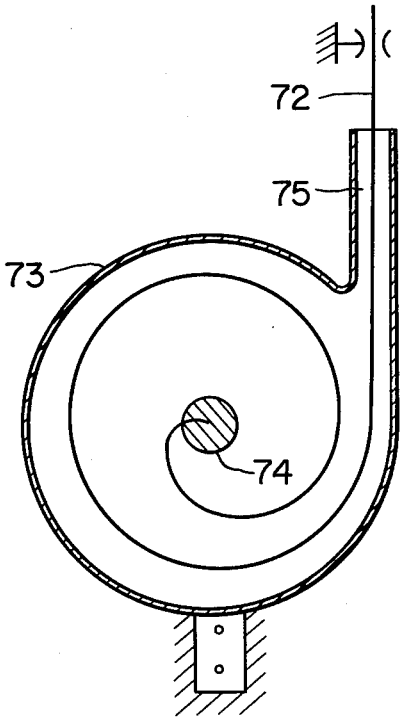

According to an advantageous feature of the present invention, a flexible cable or a cord 72 led from a stationary structure to the moving part of the operating table is partly encased in a cord winding device as shown in FIGS. 17A and 17B.

The cord winding device comprises a housing 73 of a pan-shape with circular faces of a comparatively short axial depth, and a central shaft 74 extending axially through the housing 73. The housing 73 is provided with a tangentially disposed outlet 75. The part of the cord 72 encased in the housing 73 is wound around the central shaft 74 and is anchored at its inner end to the central shaft 74. The other end of the cord is led out through the outlet 75.

The housing 73 is installed outside of the columnar member 3 in a manner such that the circular faces of the housing 73 are disposed in parallel with the outer surface of the columnar member 3. FIG. 17A shows an operational state of the cord winding device, wherein the cord has been pulled out to the greatest extent, whereas FIG. 17B shows another operational state wherein the cord has been pushed back into the cord winding device as much as possible.

A cord winding device of the above described construction can wind up an electric cord of approximately 30 cm in length which is sufficient for covering the hoisting range of the hoisting mechanism in the example of the operating table.

Since the a.c. power source and the transformers TR1 and TR2, having parts energized at the line voltage, are installed separately from the operating table as described hereinbefore with reference to FIG. 18, and, furthermore, the motor circuits and the control circuits are all formed into two-line systems (having return lines), the possibility of creating dangerous leakage current can be substantially eliminated.

Furthermore, since the motor circuits and the control circuits are separated from each other by the provision of the separate transformers TR1 and TR2 and separate rectifiers RC1, RC2, and RC3, harmful fluctuations of voltage caused in the control circuit by variation in load of the motor circuits can be prevented.

The operating table of the above description is operated as follows.

(1) Mounting of the upper structure:-

A stretcher carrying an upper structure is brought into a predetermined position relative to the columnar member 3. At the predetermined position of the stretcher, a switch S2 is closed, thus operating a relay R1 and an auxiliary relay R1a simultaneously. Contact means R1-1, R1-2 of the relay R1 is thereby opened, and contact means R1-3, R1-4 of the same relay is closed, thus preparing for the operation of the hoisting motor M1 and locking motors M5 and M6.

When a hoisting button in the remote control box RM is depressed to close contact means T1, T2, a control current flows through closed contact means R2-1, R2-2 of a relay R2, an upper limit switch LS11, and a relay R3, thus energizing the relay R3. The energization of the relay R3 establishes a circuit for operating the motor M1 in a direction to hoist the sliding member 5 and associated parts.

Here, it is assumed that the hoisting button in the remote control box RM is held depressed until the upper structure is completely mounted on the supporting members 38 and 39 coupled to the upper end of the sliding member 5.

Along with the elevation of the sliding member 5 to a predetermined intermediate position, a switch S3 is closed, thereby energizing the relay R2.

The contact arm of the contact R2-1 is thus transferred from contact R2-2 to contact R2-3, deenergizing the relay R3 and stopping the hoisting of the sliding member 5, because the energization of the relay R1 caused by the depression of the switch S2 maintains the contact means R1-1, R1-2 open.

Simultaneously with the termination of the hoisting operation of the sliding member 5 at the above stated intermediate position, the guide pin 47 incorporated with a part of the connector 66 engages the guide bush 48 incorporated with the other part of the same connector. In the circuit diagram shown in FIG. 18, the junctions denoted by *Ja*4, *Ja*5, *Ja*6, *Ja*7, *Ja*8, *Ja*9 and *Ja*10 are connections contained in one of the connectors 66, and those denoted by *Jb*4, *Jb*5, *Jb*6 and *Jb*7 are connections contained in the other connector 66.

Because the hoist button in the remote control box RM is continuously depressed, a current flows through the closed contact means R2-1, R2-3, and the closed contact means R1-4, R1-3, to the junction Ja7 in the connector 66. From the junction Ja7, the current is divided into two parts, one flowing through a contact NC of a limit switch LS1 to a relay R5, and the other part flowing through a contact NC of a limit switch LS3 to a relay R7.

Thus, the relays R5 and R7 are energized for operating the locking motors M6 and M7. Upon completion of the locking between the upper structure and the supporting members 38 and 39, limit switches LS1 and LS3 are both moved to the No side thereby interrupting the currents flowing through the relays R5 and R7 and stopping the operation of the electric motors M6 and M5, respectively.

When the upper structure is properly locked to the supporting members 38 and 39, lock confirming switches LS13 and LS14 are also shifted to the locked positions, thus assuring the interruption of the currents flowing through the relays R5 and R7 and keeping the locking motors M6 and M5 in the stopped state. However, if the locking of the upper structure to the supporting members is improper, the lock confirming switches LS13 and LS14 are not operated, and the motors M6 and M5 are continuously operated, regardless of the operation of the limit switches LS1 and LS3, until the upper structure is locked properly to the two members.

When the lock confirming switches LS13 and LS14 operate as described above, currents flow through the following two circuits including:

(1) the contact No of the switch LS1, a contact No of the switch LS13, a relay R9, and
(2) the contact No of the switch LS3, a contact No of the switch LS14, and a relay R11.

Thus, the relays R9 and R11 are operated, thereby closing their locking contacts R9-1 and R11-1 and a circuit from the contact Ja9 in the connector 66, through the locking contacts R11-1 and R9-1 of the relays R11 and R9, the contact Ja5 in the connector 66, and an upper limit switch LS11, to the relay R3 is established. Then the hoisting motor M1 again starts to hoist the sliding member 5 regardless of the aforementioned intermediate position of the sliding member 5.

When the sliding member moves above the intermediate position, the switch S3 is brought to OFF, thereby deenergizing the relay R2 and connecting the contact R2-1 with the contact R2-2, and thus deenergizing relays R9 and R11. However, when the hoisting button is still depressed to close the contact means T1, T2, the relay R3 is energized through the contact R2-2, instead of the above described circuit through the locking contacts, so that the sliding member 5 continues its upward movement. In the above described operation, since the locking contacts R9-1 and R11-1 of the relays R9 and R11 are connected in series (forming an AND circuit), the restarting of the hoisting motor M1 at the time of the completion of the locking operation does not occur if either one of the locking operations is insufficient.

(2) Operations after upper structure is mounted:

If, after the completion of the process of mounting the upper structure onto the supporting members 38 and 39, the stretcher is withdrawn from the predetermined position, the relay R1 and the auxiliary relay R1a will be both deenergized by the opening of the switch S2. Accordingly, when a hoisting button is pushed in the remote control box RM to close the contacts means T1, T2, the table hoisting motor M1 is operated through a circuit including the hoisting button contact means, closed contacts R1-1 and R1-2, and the relay R3. In this state, the hoisting motor M1 is continuously energized, regardless of the position of the switch S3 until the upper limit switch LS11 opens when the sliding member 5 has reached the upper limit position.

More specifically, since the switch S2 is opened, the relay R1 is not energized, thus bringing the contact means R1-3, R1-4 into OFF state. For this reason, no current flows through the switches LS1 and LS3 regardless of the closing of the switch S3 at the intermediate position and the energization of the relay R2 causing the closure of the contacts R2-1 and R2-3. As a result, the relays R9 and R11 are not energized even in the case where the switches LS1, LS3, LS13, and LS14 are accidentarily closed mechanically, thereby establishing a circuit to the relays R9 and R11. Thus, the upper structure locked onto the supporting members 38 and 39 can be elevated to any desired position within the range defined by the upper and lower limit positions, inclusive of the intermediate position.

When the lowering of the upper structure inclusive of the supporting members 38 and 39 is desired, lowering circuits including:

(1) the contacts T1 and T3, contacts R2-4 and R2-5 of the relay R2, a limit switch LS12, and a relay R4, and
(2) the contacts T1 and T3, contacts R1-5 and R1-6 of the relay R1, the limit switch LS12, and, the relay R4, are established. Accordingly, the relay R4 is energized, and the hoisting motor M1 is thereby operated in the reverse direction thereby lowering the upper structure until the switch LS12, which is a lower limit switch, is operated.

During the lowering operation of the upper structure together with the supporting members 38 and 39, when the sliding member 5 passes through the intermediate position, the switch S3 is closed, thereby energizing the relay R2 and thereby closing the contact means R2-4, R2-6 of the relay R2. However, since the auxiliary relay R1a is not energized, unlock prohibiting contact means R1a-1 associated therewith is kept in OFF state, and therefore no current flows through the circuits including:

(1) the junction Ja8, a limit switch LS2 and an an unlocking relay R6, and
(2) the junction Ja8, a limit switch LS4 and an unlocking relay R8. In other words, unlocking of the upper structure from the supporting members when they are moved to pass the intermediate position during the descending operation is prevented.

Likewise, even in the case where the vertically movable combination, including the upper structure and related parts, is once stopped at the intermediate position, thus switching the contact R2-4 of the relay R2 to the contact R2-6, the descending movement of the combination is immediately started by simply depressing the lowering button because the relay R1 is not operated in this case, and the contacts R1-5 and R1-6 are held in the mutually conducting state. In other words, the combination can be started and stopped at any position between the upper and lower limit positions while it is in the course of the lowering operation.

(3) Operation of back supporting frame:-

(a) Upward swing of the frame:

When an elevating button in the remote control box RM for operating the back supporting frame 9 is depressed to close contacts T4 and T5, a circuit including: the contacts T4 and T5, the junction *Jb*4, a limit switch LS6, and a relay R14, is established. The relay R14 is thus energized, thereby operating a motor M4 for the back supporting frame 9 in the elevating ditection until the switch LS6, as an upper limit switch, is opened.

(b) Downward swing of the frame:

When a lowering button in the remote control box is depressed to close contact means T4, T6, a circuit including:

the contact means T4, T6, the junction Ja4, a limit switch LS5, and a relay R13, is established. The relay R13 is thus energized, thereby operating the motor M4 for operating the back supporting frame 9 in the descending direction until the switch LS5, as a lower limit switch, is operated.

(c) Automatic resetting of the back supporting frame:

In the case where the back supporting frame 9 is to be reset to a horizontal position from an elevated position, an automatic reset button RS is operated to close contact means T7, T8 and a circuit including: the contacts T7 and T8, the junction Jb9, a normally closed contact NC of a switch NS2, a normally closed contact NC of a switch NS1 and a diode D1, is established. The relay R13 is thus energized, and the electric motor M4 for operating the back supporting frame is operated in the reverse direction, thereby lowering the back supporting frame. When the frame is lowered to the horizontal or neutral position, the switch NS1 is reversed thereby to shift its contact to the NO side, and the motor M4 is thereby stopped.

In the case where the back supporting frame is to be reset to the horizontal position from a lowered position, the switch NS2 is switched to the NO side, and therefore a circuit including: the contacts T7 and T8, a contact NO of the switch NS2, and a diode D2, is established, thus energizing the relay R14, and the motor M4 is operated in the forward direction, thereby elevating the back supporting frame. At the horizontal or neutral position, the switch NS2 is reversed to the NC side, thereby stopping the motor M4. The switch NS1 is at this time at the NO position, whereby the motor M4 is kept inoperative.

(4) Rotation around transverse axis:-

(a) In the direction to elevate head supporting frame:

A head elevating button in the remote control box RM is depressed to close contact means T9, T10. A circuit is established through the path including: the contacts T9 and T10, a limit switch LS8, and a relay R16, for energizing the relay R16. The electric motor M3 is thereby operated to rotate the upper structure around its transverse axis in the direction for elevating the head supporting frame 10 upward. The motor M3 is stopped when the limit switch LS8 is actuated.

(b) In the direction for lowering the head supporting frame:

When a button for lowering the head frame is depressed to close contact means T9, T11, a circuit through the path including: the contact T9 and T11, a limit switch LS7, and a relay R15, is established to energize the relay R15, and the electric motor M3 is operated in the reverse direction. Until the limit switch LS7 is opened.

(c) Automatic reset:

In the case where the upper structure which has been rotated in the direction for elevating the head supporting frame thereof is to be reset, the reset button RS is depressed. Because limit switches NS3 and NS4 are in NC and No positions, respectively, a current flows through the path including: the contacts T7 and T8, a contact No of the switch NS4, a contact NC of the switch NS3, and a diode D3, thus energizing the relay R15. The electric motor M3 is operated in the reverse direction and stops when the switch NS3 is reversed to No at the neutral position.

Conversely, when the upper structure which has been rotated in the direction for lowering the head supporting frame is to be reset, a circuit including: the contacts T7 and T8, a contact NC of the switch NS4, and the relay R16, is established, thereby energizing the relay R16 and operating the electric motor M3 in the forward direction. When the switch NS4 is turned to No at the neutral position, the electric motor stops.

(5) Rotation around longitudinal axis:

When contact means T12, T13 or T12, T14 in the remote control box RM is closed, the circuits including the following are established, respectively.

(1) The contacts T12 and T13, a limit switch LS10, and a relay R18, and (2) the contacts T12 and T14, a limit switch LS9, and a relay R17, and the motor M2 is operated in respective directions.

In the case of resetting from a "left side elevated" state, or from a "right side elevated" state, one of the following circuits is established.

(1) The contacts T7 and T8, a switch NS6, a diode D6 and a relay 18, and (2) the contacts T7 and T8, the switch NS6, a switch NS5, a diode D5, and the relay 17.

(6) Features common for automatic resettings:-

(a) In any of the circuits for operating the back supporting frame 9, and for rotating the upper structure around the transverse or longitudinal axes, the switches provided in a pair (such as NS1 and NS2) are mutually interlocked mechanically and electrically, so that when one of the switches passes a current, the other switch passes no current. Thus, there is no possibility of the relays (such as R13 and R14) operating simultaneously.

(b) The reason for providing diodes (such as D1 and D2) between the NS switches and relays is as follows.

In the ordinary operation such as the lowering of the back supporting frame 9, the aforestated circuit including the switch LS5, the relay R 13 and so on is established for operating the electric motor M4 in the reverse direction. In this case, if the diode D1 were not provided between the switch NS1 and the relay R13, a part of the current would tend to flow back through any of the switches NS3, NS4, NS5, and NS6, now conducting, to those corresponding thereto of the relays R15, R16, R17, and R18, thus operating the relay or relays erroneously. The diode D1 functions to eliminate such erroneous operations of the relays, except at the time of the automatic resetting.

(c) When the automatic resetting button RS in the remote control box RM is depressed, a circuit is established, through mutually closed contacts R1-8 and R1-9 of the relay R1, and the closed contacts T7 and T8, to the neutral position detecting switches NS1 through NS6. Thus the contact relays are operated through any of the detecting switches operating at that time, and the motor or motors are operated in accordance with the control relays, thereby bringing the movable parts of the operating table to their neutral positions.

It should be noted that when the automatic reset button RS is depressed, the circuits leading to the other buttons for operating the back supporting frame, and for the transverse and longitudinal rotations of the upper structure are all interrupted because the contacts of these other buttons are connected to the power sourse through a normally closed contact T15 of the automatic reset button switch.

Thus, a precautionary safety feature preventing operation of the electric motors for the movements of the upper structure and the back supporting frame of the structure is provided.

(7) Transfer of the upper structure onto stretcher:-

(a) With the upper structure placed in the proximity of the upper limit of its elevation, a stretcher is advanced to a predetermined position relative to the columnar member 3. The switch S2 is thereby actuated to operate the relay R1 and the auxiliary relay R1a. The contacts R1-1 and R1-2 and the contacts R1-5 and R1-6 are all brought to OFF, and the unlock prohibiting contacts of the auxiliary relay R1a is brought to ON, thus completing the preparatory operation.

Simultaneously, the contact R1-8 of the relay R1 is connected to the side of the contact R1-10, thus establishing an automatic reset circuit (without requiring the depression of the reset button) and bringing the upper structure to the completely horizontal state even in the cases where the automatic resetting operation caused by the depression of the reset button in the remote control box has been insufficient. The automatic resetting operation due to the closure between the contacts R1-8 and R1-10 of the relay R1 has priority over the automatic resetting operation caused by the depression of the reset button RS. Therefore, in the course of the automatic resetting operation caused by the placement of the stretcher at the predetermined position relative to the columnar member, all of the movements of the upper structure and the back supporting frame thereof are prohibited except the raising and lowering of the sliding member 5. That is, the depression of any button other than those for raising and lowering of the upper structure causes no movement corresponding to that button.

(b) When the lowering button is depressed, the relay R4 is energized through the circuit starting from the lowering button contact T3, the contacts R1-5 and R1-6, and the switch LS 12, as described hereinbefore, and the hoisting motor M1 is operated in the reverse direction.

(c) When the upper structure and hence the sliding member 5 are lowered to the intermediate position, the switch S3 is actuated, thereby operating the relay R2, as decribed hereinbefore, and the relay R4 is made inoperative, and the lowering operation of the motor M1 is stopped. Then, the unlock relays R6 and R8 are energized to operate the locking motors M5 and M6 in the direction for unlocking the upper structure from the supporting members 38 and 39, as described previously.

(d) Upon completion of the unlocking operation, the limit switch LS2 and LS4 are shifted to the side of the normally opening contacts No connected to relays R10 and R12, respectively, and a current flows through contacts R10-1 and R12-1 of the relays R10 and R12, connected in series, normally closed contact of the limit switch LS12 to the relay R4, thus operating again the motor M1 in the lowering direction.

As in the case of the locking operation, since the contacts of the relays R10 and R12 are connected in series, the lowering operation of the motor M1 is not started unless both of the limit switches LS2 and LS4 are actuated to the side of the normally opened contacts No. That is, the lowering operation is resumed when both the sides of the central frame 8 are completely unlocked. When the unlocking operation is completed, all of the switches relating to locking, such as LS1, LS3, LS13, and LS4, are brought back to their original state (to be ready for the locking operation), but are not operated to lock the upper structure unless the hoisting button is depressed again.

(e) Upon resumption of the lowering operation, the upper structure rides on the stretcher, and the supporting members and the like, which are unlocked from the upper structure, are lowered continuously. When these members pass over the intermediate position, the switch S3 is released, thus deenergizing the relay R2, and connecting the contact R2-4 to the contact R2-5. As a result, the circuit including the contacts R2-4 and R2-6, the contact R1a-1 and so on is broken, and the current flowing through the circuit comprising the series connected contacts R12-1 and R10-1 of the relays R12 and R10, the junction Jab, the limit switch LS12, and the relay R4 is interrupted. However, at this instant, the relay R4 is energized by a current flowing through a circuit passing through the contact T3 of the lowering button, mutually closed contacts R2-4 and R2-5, and the normally closed limit switch LS12, whereby the motor M1 continues its operation in the lowering direction until the lower limit switch LS12 is opened.

(8) Moving out of the Stretcher:

After the upper structure of the operating table rides on the stretcher as described above, and the separation thereof from the supporting members has been completed, the stretcher is moved out of the columnar member. Thus, the switch S2 is opened, placing the relay R1 and the auxiliary relay R1*a* in OFF state and resetting all circuit elements to their original states.

We claim:

1. In an electrically driven, separate type, surgical operating table comprising an upper structure for supporting the body of a patient, a lower structure including support means for supporting the upper structure in a detachable manner, first drive means for moving said support means vertically relative to other parts of the lower structure, second drive means for rotating said support means about longitudinal and transverse axes of the operating table, guiding means for bringing the upper structure and said support means of the lower structure into predetermined relative positions, said guiding means comprising at least one combination of a first guide member carried by said support means and a second guide member carried by said upper structure, one of said guide members being a guide pin and the other guide member being a guide bush, and the operating table also comprising locking means for locking the upper structure onto said support means of the lower structure, the improvement wherein (a) said first and second guide members are respectively combined with first and second mating parts of an electric connector which establishes electric connection between said mating parts when said first and second guide members are fully engaged, the first part of the connector being connected to an electric power source, (b) said locking means comprises at least one combination of a first threaded member provided in said support means and a second threaded member provided in said upper structure, one of said threaded members being a locking screw and the other threaded member being a nut which is threadedly engageable with said locking screw, (c) said upper structure supports therein third drive means for driving said second threaded member relative to said first threaded member for locking and unlocking operation between said support means of the lower structure and said upper structure (d) said upper structure supports therein fourth drive means for adjusting the upper structure itself independently of the lower structure, said third and fourth drive means being electrically operable and being connected to the second part of the electric connector whereby, when said first and second guide members are fully engaged, said third and fourth drive means are connected to the power source through said connector, and (e) circuit means are provided to cause said third drive means to become operative for the locking and unlocking operation at a predetermined vertical position of said support means of the lower structure, while causing said first drive means to become inoperative.

2. The surgical operating table as set forth in claim 1, wherein the third and fourth drive means are operable by current supplied at a lower voltage than the power distribution line voltage of the district in which the operating table is located.

3. The surgical operating table as set forth in claim 1, wherein the first and second drive means are electrically operable, and are operable by current supplied at a lower voltage than the power distribution line voltage of the district in which the operating table is located.

4. The surgical operating table as set forth in claim 1, wherein said circuit means are operable to control operation of said third and fourth drive means by current supplied at a lower voltage than the power distribution line voltage of the district in which the operating table is located.

5. The surgical operating table as set forth in claim 1, including electrical control circuitry for controlling operation of the second and fourth drive means, said electrical control circuitry being operable by current supplied at a lower voltage than the power distribution line voltage of the district in which the operating table is located.

6. The surgical operating table as set forth in claim 1, wherein said upper structure includes a first section for supporting a patient's hips and a second section for supporting the patient's back, the second section being connected to the first section so as to be pivotable with respect thereto about a pivot axis which extends transversely of the operating table, and wherein said fourth drive means is connected to drive the second section to pivot with respect to the first section about said pivot axis.

7. The surgical operating table as set forth in claim 6, wherein said fourth drive means is carried by said first section of the upper structure, and has an output drive shaft coupled to drive a toothed gear wheel to rotate about an axis parallel to said pivot axis, and said second section of the upper structure carries a member shaped as a sector of an annulus and having gear teeth at its interior in meshing engagement with said toothed gear wheel.

8. The surgical operating table as set forth in claim 1, wherein said first drive means is electrically operable and said circuit means comprises contact means operated in response to completion of the locking and unlocking operation of the locking means and connected in series with the circuit for said first drive means, whereby any vertical movement of said support means before the completion of the locking and unlocking operation is prevented.

9. The surgical operating table as set forth in claim 1, further comprising contact means operable in response to positioning of a stretcher at a predetermined position relative to the lower structure, and reset means for automatically bringing said support means into a horizontal position with respect to the longitudinal and transverse axes of the table in response to the operation of said contact means.

* * * * *